US005433055A

United States Patent [19]

Schliep

[11] Patent Number: 5,433,055

[45] Date of Patent: Jul. 18, 1995

[54] PARALLEL WELDED BOX BEAM TRUSS MEMBER

[76] Inventor: Edward J. Schliep, 630 Adams St., NE., Minneapolis, Minn. 55418

[21] Appl. No.: 154,095

[22] Filed: Nov. 18, 1993

[51] Int. Cl.[6] ..... E04C 3/02

[52] U.S. Cl. ..... 52/694; 52/691; 52/693; 52/692

[58] Field of Search ..... 52/693, 648.1, 690–692, 52/694

[56] References Cited

U.S. PATENT DOCUMENTS

| | | | |
|---|---|---|---|
| 3,345,792 | 10/1967 | Chandler | 52/693 |
| 4,506,487 | 3/1985 | Hill | 52/690 |
| 4,562,683 | 1/1986 | Gottlieb | 52/693 |
| 4,569,177 | 2/1986 | Ottinger | 52/694 X |
| 4,630,424 | 12/1986 | Eberle | 52/693 |
| 4,642,830 | 2/1987 | Richard | 52/693 X |
| 4,827,688 | 5/1989 | Tene | 52/694 |
| 4,829,739 | 5/1989 | Coppa | 52/693 X |
| 4,887,406 | 12/1989 | Saia | 52/694 |
| 4,907,390 | 3/1990 | Tene | 52/694 |
| 5,008,967 | 4/1991 | Barrios | 52/693 X |

*Primary Examiner*—Carl D. Friedman
*Assistant Examiner*—Beth A. Aubrey

[57] ABSTRACT

A truss member for the erection of a building structure being fabricated in twenty eight foot lengths having top and bottom full length 2×4 members having intermediate angled hardwood members with spaced vertical hardwood members and plywood full length at each side thereof and at either outer side the full length thereof angled iron members and at each end thereof transverse bolts forming a unitary parallel metal truss box beam member requiring no bearing walls in providing overhead support reducing the cost of fabrication relative to a prior art truss member on the order of fifty percent and reducing the time and cost of erecting a frame structure by substantially a like amount of savings.

7 Claims, 2 Drawing Sheets

PARALLEL WELDED BOX BEAM TRUSS MEMBER

BACKGROUND OF THE INVENTION

1. Field of Invention

This invention is involved in the fabrication of load bearing truss members used in the erection of a building structure.

2. Description of the Prior Art

In general previous art truss members are made of two by fours of southern pine having southern pine bridging between vertically spaced full length two by fours, the bridging being secured by metal plates. These trusses require spaced load bearing support members and are primarily made of wood member parts.

SUMMARY OF THE INVENTION

A primary object of this invention is to provide a fabricated truss member substantially superior to prior art truss members in having increased unsupported load bearing strength.

It is a further object herein to provide a fabricated truss member the cost of fabrication of which is substantially on the order of fifty percent less than comparable prior art truss members and requiring on the order of one half the number of prior art truss members which would be required.

It is a further object herein to provide a fabricated truss member having such adequate load bearing capacity that on the order of only fifty percent as many truss members are required in a comparable structure.

In view of the previous object, it is a further object herein to substantially reduce construction time and corresponding construction costs as a result of installing a fewer number of truss members and a substantially lesser number of supporting load bearing members or walls to install.

These and other objects and advantages of the invention will be set forth in the following description made in connection with the accompanying drawings in which like reference characters refer to similar parts throughout the several views.

BRIEF DESCRIPTION OF THE DRAWINGS

FIG. 1 is a view in side elevation of a truss member on a reduced scale;

FIG. 2 is a broken view similar to that of FIG. 1 on a somewhat larger scale showing details of internal structure in dotted line;

FIG. 3 is a broken portion of the structure of FIG. 2 on an enlarged scale showing magnified details of internal structure;

DESCRIPTION OF A PREFERRED EMBODIMENT

Figure 4:
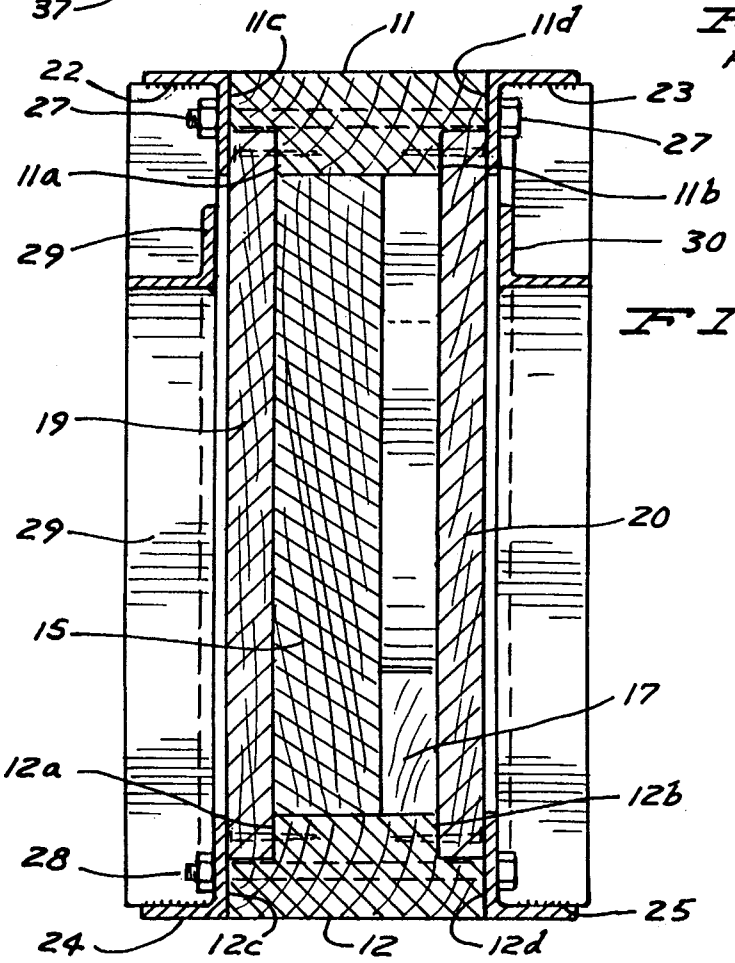
FIG. 4 is a view on an enlarged scale in vertical section taken on line 4—4 of FIG. 3 as indicated.

Referring to FIG. 1, the truss member comprising the invention herein is indicated generally by the reference numeral 10 and portions thereof are shown on an increasingly larger scale in FIGS. 2 and 3. Reference is also had to FIG. 4 for enlarged detail of elements of internal construction or fabrication.

Referring to the Figs., the truss member 10 comprises a pair of vertically spaced 2×4 commonly used wood members or beams 11 and 12 having for purposes herein lengths of 28 feet. As indicated in FIG. 4, said beams are respectively notched longitudinally at their facing corners as at 11*a*, 11*b* and 12*a* and 12*b*. Said notches for purposes herein have a depth of $\frac{5}{8}$ inches and a length of $\frac{3}{4}$ inches.

Spacing said members 11 and 12 are longitudinally spaced vertical upright or vertical members 15 which have a height on the order of 16 inches and the same are securely nailed to said 2×4 beams 11 and 12. Said uprights are respectively secured to the ends of said beams spaced therefrom and in spaced relation to one another at one side of the center of said beams.

Disposed between said upright or vertical members 15 as bridging are angled or diagonally positioned 1×3 oak members 17 which respectively extend from midcenter of one upright 15 to the next as shown in FIG. 3, the same being secured at their ends to said upright members by means of both glue and by screws as indicated at 17*a*. This bridging increases the load bearing capacity of the beams 11 and 12.

Next plywood boards 19 and 20 the length of said members 11 and 12 are placed to be set into said notches 11*a* and 12*a* to overlie and extend between each side of the members 11 and 12 and be secured thereto with an appropriate adhesive and also be adhesively secured respectively to said members 15 and 17 wherein there is physical contact with the same.

With the plywood sides secured to and made integral with the truss member 10, next, opposed pairs of L-shaped angled iron members 22–23 and 24–25 are positioned at the opposed upper and lower end sides of said truss member as at 11*c*≅11*d* and 12*c*–12*d* and said pairs of angled iron members respectively are secured together with said truss member therebetween by transverse bolts 27 and 28 extending therethrough at spaced intervals longitudinally of said angled iron members.

To further secure said truss member 10 and increase the rigidity thereof, angled metal strips 29 and 30 are reversely diagonally disposed between said angled members 22–23 and 24–25 and are welded at their abutting ends and to the adjacent engaged portions of the angled members 22–23 and 24–25. Thus a very rigid integral truss member is formed.

Figure 7:
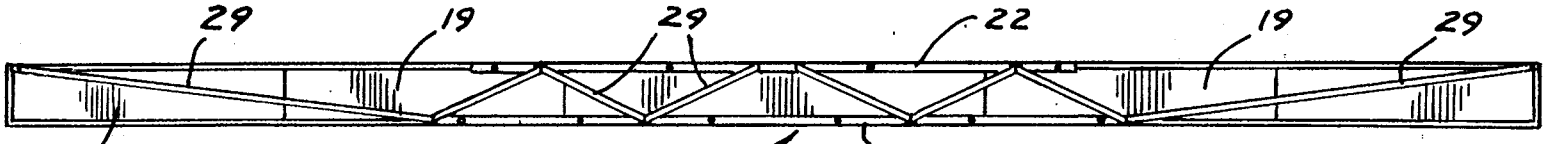
Figure 8:
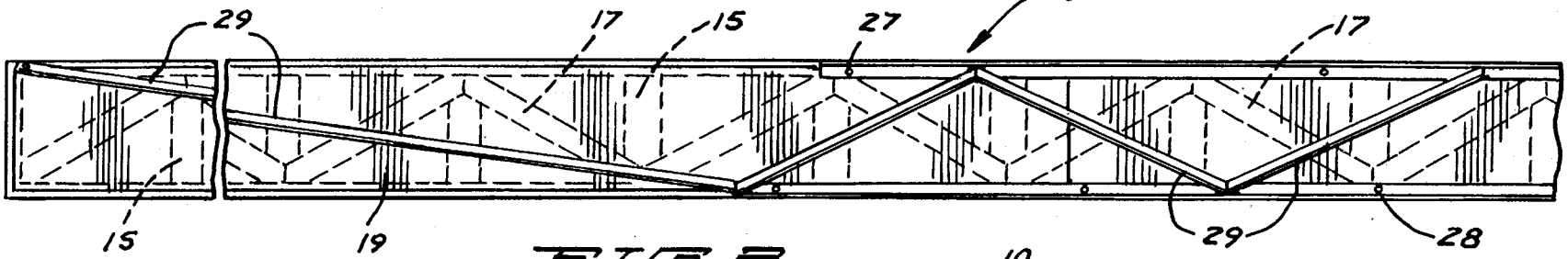
Figure 9:
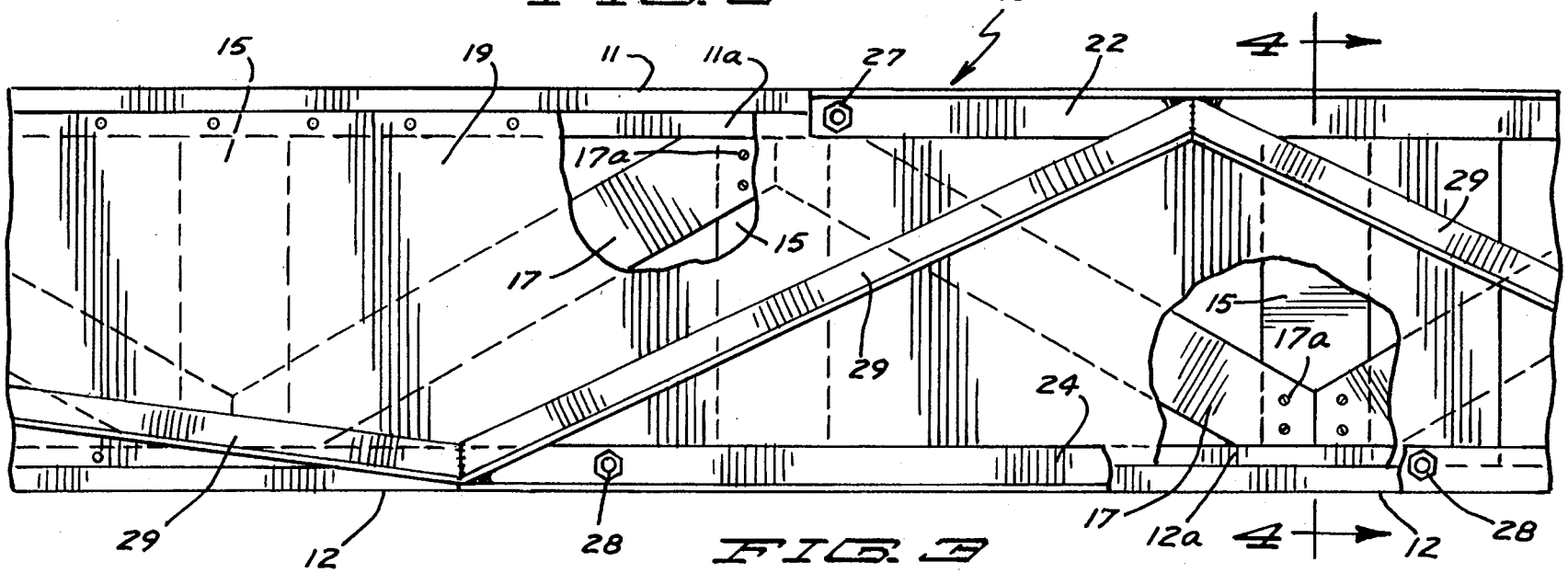
Figure 5:
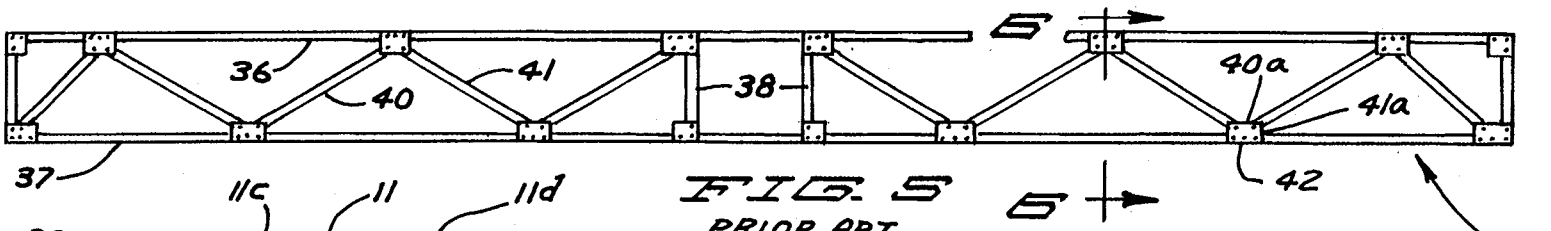
FIG. 5 PRIOR ART
FIG. 5 is a view in side elevation of a prior art truss structure.
Figure 6:
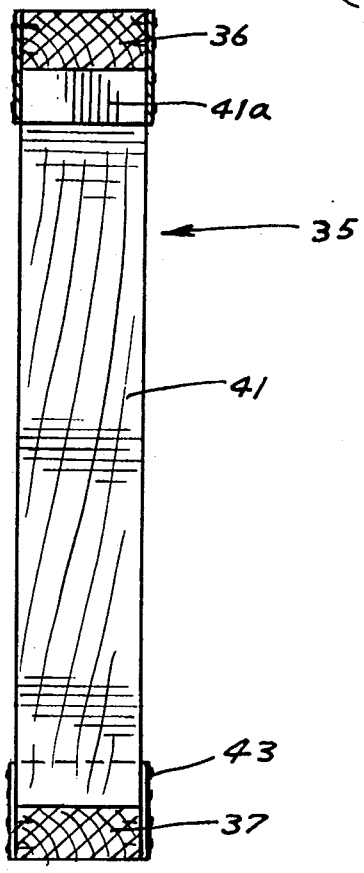
FIG. 6 PRIOR ART
FIG. 6 is a view in vertical section taken on line 6—6 of FIG. 5 as indicated.

In contrast to the above described structure of a truss structure, a commonly used prior art structure 35 is shown in FIGS. 5 and 6. The prior art structure comprises a pair of vertically spaced 2×4 members 36 and 37 which for purposes herein are 28 feet in length and are held in spaced relation by longitudinally spaced vertical members 38, the same being commonly made of southern pine.

To provide some rigidity to said prior art truss member, a bridge work of diagonally disposed 2×4 members 40 and 41 are positioned between said members 36 and 37 having abutting ends as at 40*a* and 41*a* as illustrated except at the ends of said members 36 and 37 and also centrally of said members 36 and 37 where the vertical members 38 provide the support. At each position where the abutting ends or single ends of the diagonal members engage the 2×4 member 36 or 37 and where the ends of the vertical members free of an abutting end of a diagonal member engages one or the other of said 2×4 members, a metal plate 42 overlies the respective of said ends and the adjacent portion of the 2×4 36 or 37, as the case may be, the same are all nailed together as indicated by the nails 43 in FIG. 6. Thus it is seen the prior art structure is less rigid in its overall structure and has significantly less weight bearing capacity.

Truss members are required to be tested for load bearing capacity. The applicant's parallel beams can readily support a 4 foot floor section 28 feet long whereas the prior art structure can carry only on the order of a 16 to 24 inch section.

Applicant's structure is very cost effective as a prior art floor span would have an effective cost of $4.00 a foot whereas applicant's truss requiring a lesser number to be used would have a cost on the order of $1.75 per foot.

A load bearing test was conducted which consisted of placing a 4000 lb. weight on a 28 foot span of applicant's truss which bowed $\frac{5}{8}$ inches, at 5000 lbs. bowed 1 inch and at 6000 lbs. it bowed $1\frac{3}{8}$ inches. The prior art truss could not support a 4000 lb. weight without a load bearing support thereunder.

This test is more sever than any normal stress that would be present in a structure and satisfies all building requirements for a license to build.

As a result of its load bearing capacity, the applicant's structure results in relatively fewer truss members being required in a comparable structure and further, applicant's truss members require no intermediate load bearing supports as does the prior art structure. Thus both material costs and construction or labor costs are substantially reduced. This cost reduction is estimated to be at least 50% of the cost involved with prior art truss structures.

The applicant's structure represents a significant unprecedented improvement in the art of related construction.

It will of course be understood that various changes may be made in the form, details, arrangement and proportions of the invention without departing from the scope of the invention which, generally stated, consists in a product capable of carrying out the objects above set forth, in the parts and combination of parts disclosed and defined in the appended claims.

What is claimed is:

1. A fabricated truss member for the erection of a building structure, having in combination a pair of vertically spaced longitudinally extending beams, a plurality of vertically disposed spacing members at the ends of said beams and spaced therebetween holding said beams in vertically spaced relation, a plurality of reversely diagonally disposed bridging members between said beams, said bridging members having abutting ends overlying said vertical members, said ends being secured to said vertical members, said beams being notched longitudinally at their vertically facing corners of the ends thereof, a sheet of plywood being secured at each side of said beams between said notched corners the full length thereof, pairs of L-shaped angled iron members at opposed upper and lower ends of said beams, said iron members being secured by transverse securing means to said beams at spaced intervals therealong, and a plurality of oppositely diagonally disposed angled iron members 29 and 30 at the respective out facing sides of and secured as by welding to said L-shaped angled iron members.

2. The structure of claim 1, wherein said beams are 2×4 wood members having a length of twenty-eight feet.

3. The structure of claim 1, wherein said bridging members are on the order of 1×3 inch oak members.

4. The structure of claim 1, wherein said transverse securing means consist of bolts.

5. A fabricated truss structure for the erection of a building structure, having in combination a pair of vertically spaced longitudinally extending beams, means spacing said beams in vertically spaced relation, said means being positioned at one side of the longitudinal center of each of said beams, a plurality of reversely diagonally disposed bridging members between said beams, said bridging members having abutting ends overlying and being secured to said means, said bridging members being positioned alongside of said means at the other side of said center of each of said beams, said beams being notched at their facing edges inwardly of the ends thereof, a sheet of rigid material at each side of said beams is set into said notched edges of said beams and secured to said spacing means and said bridging members, a plurality of angle members diagonally disposed in a bridging effect at the outer sides of said sheets of rigid material, and tranverse securing means securing together said angle members at each side of said beams making said structure a rigid integral member.

6. The structure of claim 5, wherein said transverse securing means comprise overlying metal plates 42 securing the ends of said angle members to said beams.

7. The structure of claim 5, wherein said transverse securing means are bolt members.

* * * * *